US009340955B2

(12) United States Patent
Shimazu et al.

(10) Patent No.: US 9,340,955 B2
(45) Date of Patent: May 17, 2016

(54) HYDRAULIC CONTROL DEVICE FOR WORK VEHICLE

(75) Inventors: Atsushi Shimazu, Toride (JP); Hiroyuki Azuma, Ushiku (JP); Kazuo Chounan, Moriya (JP); Yasunori Miyamoto, Ryugasaki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 635 days.

(21) Appl. No.: 13/696,537

(22) PCT Filed: May 6, 2011

(86) PCT No.: PCT/JP2011/060601

§ 371 (c)(1),
(2), (4) Date: Nov. 6, 2012

(87) PCT Pub. No.: WO2011/138963

PCT Pub. Date: Nov. 10, 2011

(65) Prior Publication Data

US 2013/0047598 A1 Feb. 28, 2013

(30) Foreign Application Priority Data

May 7, 2010 (JP) ..... 2010-107255

(51) Int. Cl.
*F15B 13/16* (2006.01)
*E02F 9/22* (2006.01)
*E02F 3/43* (2006.01)

(52) U.S. Cl.
CPC ..... *E02F 9/2282* (2013.01); *E02F 3/431* (2013.01); *E02F 9/2207* (2013.01); *E02F 9/2285* (2013.01); *E02F 9/2296* (2013.01)

(58) Field of Classification Search
CPC ..... E02F 9/2282; E02F 3/432; E02F 3/431; E02F 3/433; E02F 9/22; E02F 9/2203; F15B 11/162; F15B 13/022; F15B 13/015
USPC ..... 277/496–499; 91/358 R, 392; 60/446
See application file for complete search history.

(56) References Cited

U.S. PATENT DOCUMENTS 5,182,908 A * 2/1993 Devier et al. ..... 60/420
5,446,980 A 9/1995 Rocke (Continued)

FOREIGN PATENT DOCUMENTS

CN 1217769 A 5/1999
CN 1550617 A 12/2004

(Continued)

OTHER PUBLICATIONS

Chinese Office Action dated Jul. 31, 2014 (eight pages).

(Continued)

*Primary Examiner* — Nathaniel Wiehe
*Assistant Examiner* — Dustin T Nguyen
(74) *Attorney, Agent, or Firm* — Crowell & Moring LLP

(57) ABSTRACT

A hydraulic control device for a work vehicle includes: a hydraulic pump that supplies pressure oil; an arm drive actuator that drives, with pressure oil supplied from the hydraulic pump, an arm attached to the work vehicle so as to swing the arm; a bucket drive actuator that drives, with pressure oil supplied from the hydraulic pump, a bucket attached to a front end of the arm, so as to swing the bucket; an arm drive pressure oil control valve that controls drive of the arm drive actuator by controlling pressure oil supplied from the hydraulic pump to the arm drive actuator; a bucket drive pressure oil control valve that controls drive of the bucket drive actuator by controlling pressure oil supplied from the hydraulic pump to the bucket drive actuator; an arm operation unit that controls the arm drive pressure oil control valve; a bucket operation unit that controls the bucket drive pressure oil control valve; an operating state detection unit that detects operating states of the arm drive actuator and the bucket drive actuator; and a flow control valve that restricts pressure oil to be supplied to the arm drive actuator as combined operation of the arm drive actuator and the bucket drive actuator is detected via the operating state detection unit.

7 Claims, 7 Drawing Sheets

(56) References Cited

U.S. PATENT DOCUMENTS

| | | | | |
|---|---|---|---|---|
| 5,493,950 | A * | 2/1996 | Kim | 91/516 |
| 5,678,470 | A * | 10/1997 | Koehler et al. | 91/516 |
| 6,006,521 | A | 12/1999 | Fuchita et al. | |
| 6,241,482 | B1 | 6/2001 | Iga | |
| 6,618,659 | B1 * | 9/2003 | Berger et al. | 701/50 |
| 2004/0117092 | A1 * | 6/2004 | Budde | 701/50 |
| 2006/0099081 | A1 * | 5/2006 | Toda et al. | 417/1 |
| 2006/0245896 | A1 * | 11/2006 | Alshaer et al. | 414/685 |
| 2008/0016861 | A1 | 1/2008 | Toji | |
| 2009/0326768 | A1 * | 12/2009 | Shull | 701/50 |

FOREIGN PATENT DOCUMENTS

| | | | |
|---|---|---|---|
| CN | 201232216 | Y | 5/2009 |
| GB | 2 315 521 | A | 2/1998 |
| JP | 55-172452 | U | 12/1980 |
| JP | 06-193604 | A | 7/1994 |
| JP | 7-207710 | A | 8/1995 |
| JP | 7-259117 | A | 10/1995 |
| JP | 10-89308 | A | 4/1998 |
| JP | 11-71788 | A | 3/1999 |
| JP | 2000-136803 | A | 5/2000 |
| JP | 2005-127416 | A | 5/2005 |
| JP | 2006-144851 | A | 6/2006 |
| JP | 2007-120512 | A | 5/2007 |

OTHER PUBLICATIONS

International Search Report dated May 31, 2011 (two (2) pages).

* cited by examiner

HYDRAULIC CONTROL DEVICE FOR WORK VEHICLE

TECHNICAL FIELD

The present invention relates to a hydraulic control technology that may be adopted when driving an arm or a bucket mounted at a work vehicle.

BACKGROUND ART

Work vehicles such as wheel loaders known in the related art typically include a rotatable arm and a rotatable bucket mounted at the front end of the arm. The rotational motion of the arm and the bucket in such a work vehicle in the related art may be induced as they are driven via a tandem hydraulic circuit that gives priority to the rotating operation of the bucket over the arm (see patent literature 1). However, there is an issue that remains to be addressed in that arm drive is interrupted while the bucket is engaged in rotating operation, and thus the arm can no longer move smoothly. Accordingly, a parallel hydraulic circuit system that drives the arm and the bucket to engage them in rotating operation concurrently has been proposed for work vehicles (see patent literature 2).

CITATION LIST

Patent Literature

Patent literature 1: Japanese Laid Open Patent Publication No. 2000-136803

Patent literature 2: Japanese Laid Open Patent Publication No. 2005-127416

SUMMARY OF THE INVENTION

Technical Problem

The operator of the work vehicle adopting a parallel hydraulic circuit system for driving the arm and the bucket to engage them in rotating operation as described above may attempt to reset the angular position of the bucket to the horizontal position while lowering the arm after, for instance, soil in the bucket has been dumped. Under such circumstances, the arm is bound to be subjected to the downward force of gravity under its own weight and thus, the pressure in the oil chamber at the arm-drive hydraulic cylinder, from which pressure oil is supplied to drive the arm along the arm-lowering direction, will become lowered. As a result, pressure oil will be supplied into this oil chamber with priority and pressure oil will no longer be supplied to the bucket-drive hydraulic cylinder, thereby giving rise to a concern that the bucket will not be allowed to resume a predetermined position with ease.

Solution to Problem

A hydraulic control device for a work vehicle according to a first aspect of the present invention, comprises: a hydraulic pump that supplies pressure oil; an arm drive actuator that drives, with pressure oil supplied from the hydraulic pump, an arm attached to the work vehicle so as to swing the arm; a bucket drive actuator that drives, with pressure oil supplied from the hydraulic pump, a bucket attached to a front end of the arm, so as to swing the bucket; an arm drive pressure oil control valve that controls drive of the arm drive actuator by controlling pressure oil supplied from the hydraulic pump to the arm drive actuator; a bucket drive pressure oil control valve that controls drive of the bucket drive actuator by controlling pressure oil supplied from the hydraulic pump to the bucket drive actuator; an arm operation unit that controls the arm drive pressure oil control valve; a bucket operation unit that controls the bucket drive pressure oil control valve; an operating state detection unit that detects operating states of the arm drive actuator and the bucket drive actuator; and a flow control valve that restricts pressure oil to be supplied to the arm drive actuator as combined operation of the arm drive actuator and the bucket drive actuator is detected via the operating state detection unit.

According to a second aspect of the present invention, in the hydraulic control device for a work vehicle according to the first aspect, it is preferable that the flow control valve controls pressure oil to be supplied to the arm drive actuator in correspondence to pressure oil control characteristics of the bucket drive pressure oil control valve.

According to a third aspect of the present invention, in the hydraulic control device for a work vehicle according to the first or second aspect, it is preferable to further comprise: a main relief valve that defines a maximum pressure for pressure oil supplied from the hydraulic pump, wherein: the flow control valve controls pressure oil to be supplied to the arm drive actuator so to ensure that no pressure oil is guided toward a tank from the main relief valve while a flow of pressure oil toward the bucket drive actuator is cut off via the bucket drive pressure oil control valve.

According to fourth aspect of the present invention, in the hydraulic control device for a work vehicle according to any one of the first to third aspects, it is preferable that the flow control valve cuts off a flow of pressure oil toward the arm drive actuator while the bucket drive pressure oil control valve is controlled so that pressure oil is supplied to the bucket drive actuator at a maximum flow rate.

According to a fifth aspect of the present invention, in the hydraulic control device for a work vehicle according to any one of the first to fourth aspects, it is preferable that the flow control valve restricts a quantity of pressure oil output from the hydraulic pump and flowing into the arm drive actuator both when an operation of the bucket drive actuator combined with an operation of the arm drive actuator along an arm lowering direction is detected via the operating state detection unit and when an operation of the bucket drive actuator combined with an operation of the aim drive actuator along an arm raising direction is detected via the operating state detection unit.

According to a sixth aspect of the present invention, in the hydraulic control device for a work vehicle according to the fifth aspect, it is preferable that the flow control valve assures different flow rate characteristics with regard to pressure oil output from the hydraulic pump and flowing into the arm drive actuator when the arm drive actuator is operated along the lowering direction and when the arm drive actuator is operated along the raising direction.

According to a seventh aspect of the present invention, in the hydraulic control device for a work vehicle according to any one of the first to sixth aspects, it is preferable to further comprise: an angle detection unit that detects an angle of the arm; and an angle setting unit that sets a specific angle for the arm, wherein: once the operating state detection unit detects an operation of the bucket drive actuator combined with an operation of the arm drive actuator along an arm raising direction, the flow control valve starts restricting a quantity of pressure oil supplied from the hydraulic pump and flowing into the arm drive actuator only after the angle of the arm, detected via the angle detection unit, reaches the angle set at the angle setting unit.

According to an eighth aspect of the present invention, in the hydraulic control device for a work vehicle according to any one of the first to fourth aspects, it is preferable that the flow control valve restricts a quantity of pressure oil supplied from the hydraulic pump and flowing into the arm drive actuator only when the operating state detection unit detects an operation of the bucket drive actuator combined with an operation of the arm drive actuator along an arm lowering direction.

Advantageous Effect of the Invention

According to the present invention, the bucket is allowed to rotate without its rotating speed becoming lowered relative to the arm rotating speed while the arm and the bucket are engaged in combined operation.

DESCRIPTION OF EMBODIMENTS

Figure 1:
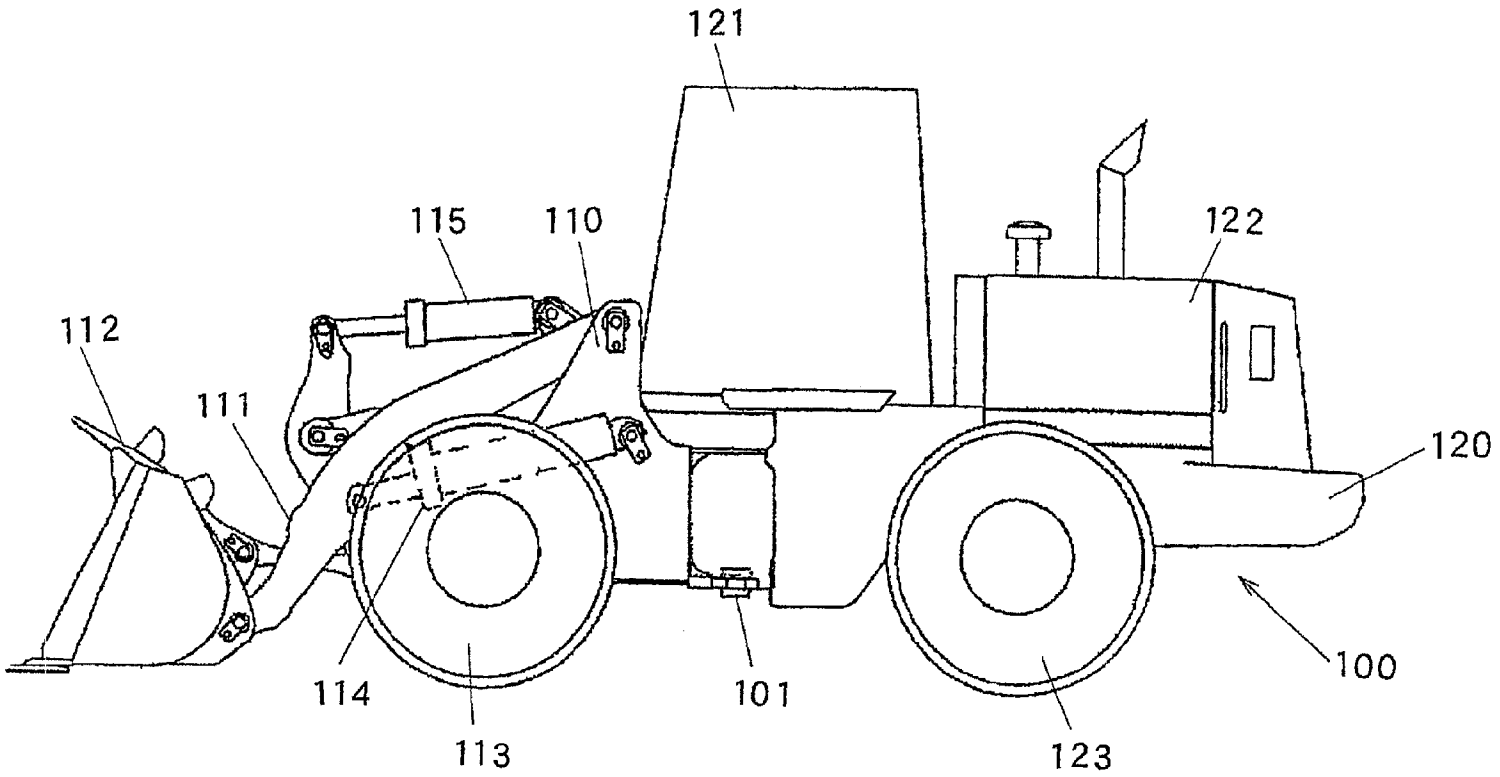
FIG. 1 is a side elevation of a wheel loader representing an example of a work vehicle equipped with a hydraulic control device according to the present invention.

In reference to FIGS. 1 through 6, an embodiment of a hydraulic control device for a work vehicle according to the present invention is described. FIG. 1 is a side elevation of a wheel loader representing an example of a work vehicle equipped with the hydraulic control device achieved in the embodiment. A wheel loader 100 comprises a front body 110 that includes an arm 111, a bucket 112, tires 113 and the like and a rear body 120 that includes an operator's cab 121, an engine compartment 122, tires 123 and the like. As the lift arm (hereafter referred to simply as the "arm") 111 is driven via an arm cylinder 114, it rotates up/down (moves upward or downward), whereas as the bucket 112 is driven via a bucket cylinder 115, it rotates up/down (the bucket 112 is engaged in a dumping operation or a digging operation). The front body 110 and the rear body 120 are connected with each other via a center pin 101 so as to articulate freely relative to each other. As steering cylinders (not shown) extend/contract, the front body 110 pivots to the left or to the right relative to the rear body 120.

Figure 2:
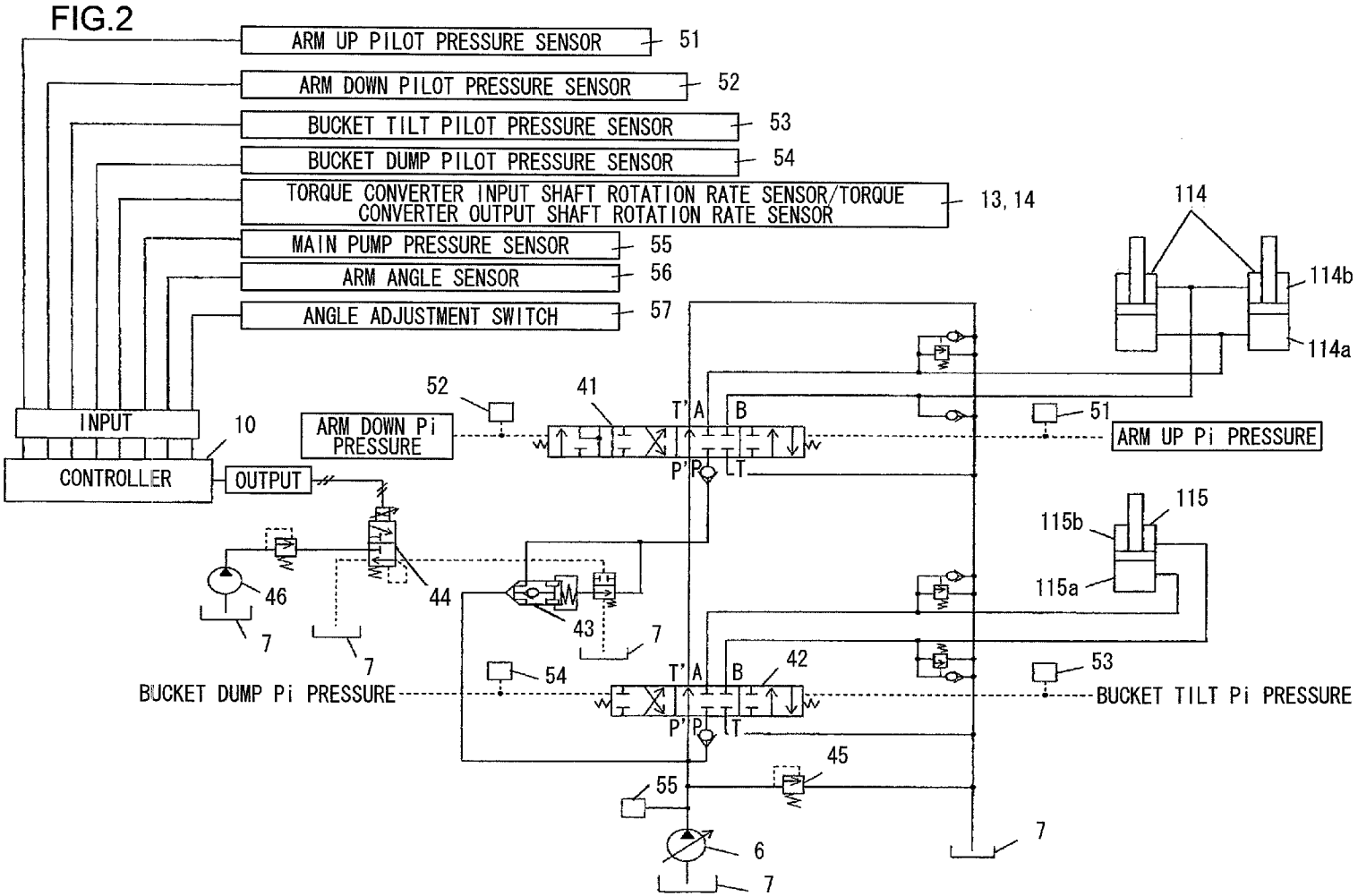
FIG. 2 shows a hydraulic circuit that drives an arm and a bucket.

FIG. 2 is a circuit diagram pertaining to the hydraulic circuit that drives the arm 111 and the bucket 112. Disposed at this hydraulic circuit are a main pump 6, which outputs pressure oil to be supplied to the arm cylinder 114 and the bucket cylinder 115, an arm control valve 41 and a bucket control valve 42, via which the direction and the flow rate of pressure oil supplied from the main pump 6 are controlled so as to control the extending/contracting strokes of the arm cylinder 114 and the bucket cylinder 115, a flow control valve 43 installed in a parallel oil passage that branches out from a pipeline located on an upstream side of the bucket control valve 42 and connects with the arm control valve 41 through a parallel connection, an electromagnetic proportional valve 44 that controls the flow control valve 43, a main relief valve 45 that defines the maximum pressure for pressure oil output from the main pump 6, and a pilot pump 46.

The bucket control valve 42 and the arm control valve 41 are respectively operated via an arm operation lever and a bucket operation lever both adopting a hydraulic pilot operation system (neither shown). These hydraulic pilot operation levers each include a pilot valve via which the pressure of pressure oil output via the pilot pump 46 is lowered in correspondence to the extent to which the particular operation lever is operated. As a pilot pressure generated via the pilot valve is applied to the corresponding control valve, i.e., the bucket control valve 42 or the arm control valve 41, the extent of switchover at the control valve is controlled.

The hydraulic circuit further includes an arm up pilot pressure sensor 51 that detects a pilot pressure applied to operate the arm control valve 41 so as to raise the arm, an arm down pilot pressure sensor 52 that detects a pilot pressure applied to operate the arm control valve 41 so as to lower the arm, a bucket tilt pilot pressure sensor 53 that detects a pilot pressure applied to operate the bucket control valve 42 so as to tilt (swing upward) the bucket, a bucket dump pilot pressure sensor 54 that detects a pilot pressure applied to operate the bucket control valve 42 so as to engage the bucket in a dumping operation (swing downward) and a pressure sensor 55 that detects the output pressure at the main pump 6, each installed on the corresponding pilot pipeline. These sensors are connected to a controller 10.

The main pump 6 and the pilot pump 46 are hydraulic pumps driven by an engine (not shown).

The arm control valve 41 is used to alter the direction and the flow rate of pressure oil supplied to the arm cylinder 114 by adjusting the spool switching position in correspondence to pilot pressures (i.e., the arm up pilot pressure and the arm down pilot pressure). The arm control valve 41 includes a P port, a P' port, a T port, a T' port, an A port and a B port.

In addition, the bucket control valve 42 is used to alter the direction and the flow rate of pressure oil supplied to the bucket cylinder 115 by adjusting the spool switching position in correspondence to pilot pressures (i.e., the bucket tilt pilot pressure and the bucket dump pilot pressure). The bucket control valve 42 includes a P port, a P' port, a T port, a T' port, an A port and a B port.

The P port of the arm control valve 41 is connected, via a check valve, to the flow control valve 43 located on the parallel oil passage, the P' port of the arm control valve 41 is connected to the T' port of the bucket control valve 42 and the T port of the arm control valve 41 is connected to a hydraulic fluid tank 7. The T' port, the A port and the B port of the arm control valve 41 are respectively connected to the hydraulic fluid tank 7, a bottom-side oil chamber 114*a* at the arm cylinder 114 and a rod-side oil chamber 114*b* at the arm cylinder 114.

The P port of the bucket control valve 42 is connected via a check valve to the main pump 6, whereas the P' port, the T' port, the T port, the A port and the B port of the bucket control valve 42 are respectively connected to the main pump 6, the P' port of the arm control valve 41, the hydraulic fluid tank 7, a bottom-side oil chamber 115*a* of the bucket cylinder 115 and a rod-side oil chamber 115*b* of the bucket cylinder 115.

When neither the arm up pilot pressure nor the arm down pilot pressure is applied to the arm control valve 41, a spool at the arm control valve 41 assumes a neutral position, with the P' port and the T' port connected to each other but the P port and the T port cut off from the A port and the B port.

When neither the bucket tilt pilot pressure nor the bucket dump pilot pressure is applied to the bucket control valve 42, a spool at the bucket control valve 42 assumes a neutral position, with the P' port and the T' port connected to each other but the P port and the T port cut off from the A port and the B port.

Displacement of the spool at the arm control valve 41 occurs so that the opening area (arm spool opening area) of the flow passage connecting the P' port to the T' port becomes gradually reduced while the opening area of the flow passage connecting the P port to the A port and the opening area of the flow passage connecting the T port to the B port each gradually increase, all in correspondence to the level of the arm up pilot pressure. In other words, as the arm up pilot pressure reaches a high level, the spool moves so that pressure oil from the main pump 6 is delivered into the bottom-side oil chamber 114*a* at the arm cylinder 114 and that the rod-side oil chamber 114*b* of the arm cylinder 114 becomes connected to the hydraulic fluid tank 7. As a result, the cylinder rod of the arm cylinder 114 extends, thereby causing an upward swing of the arm 111.

As the arm down pilot pressure becomes higher, on the other hand, the opening area of the flow passage connecting the P' port to the T' port becomes gradually reduced while the opening area of the flow passage connecting the P port to the B port and the opening area of the flow passage connecting the T port to the A port each gradually increase, all in correspondence to the level of the arm down pilot pressure. Namely, as the arm down pilot pressure reaches a high level, the spool moves so that pressure oil from the main pump 6 is delivered into the rod-side oil chamber 114*b* at the arm cylinder 114 and that the bottom-side oil chamber 114*a* of the arm cylinder 114 becomes connected to the hydraulic fluid tank 7. As a result, the cylinder rod at the arm cylinder 114 retracts, thereby causing a downward swing of the arm 111.

It is to be noted that the arm control valve 41 in the figure is allowed to assume a floating position at which the P port is cut off, the P' port and the T' port are set in communication with each other and the A port and the B port, set in communication with each other, are together connected to the T port, when the arm down pilot pressure rises to an even higher level.

The spool at the bucket control valve 42 moves from the neutral position as the bucket tilt pilot pressure rises. In correspondence to the level of the bucket tilt pilot pressure, the opening area of the flow passage connecting the P' port to the T' port becomes gradually reduced while the opening area of the flow passage connecting the P port to the A port and the opening area of the flow passage connecting the T port to the B port each increase gradually. In other words, as the bucket tilt pilot pressure reaches a high level, the spool moves so that pressure oil from the main pump 6 is delivered into the bottom-side oil chamber 115*a* at the bucket cylinder 115 and that the rod-side oil chamber 115*b* of the bucket cylinder 115 becomes connected to the hydraulic fluid tank 7. As a result, the cylinder rod of the bucket cylinder 115 extends, thereby causing an upward swing of the bucket 112. It is to be noted that an alternative expression "the bucket is tilted" may be used to refer to the bucket 112 being caused to swing upward.

As the bucket dump pilot pressure becomes higher, on the other hand, the opening area of the flow passage connecting the P' port to the T' port becomes gradually reduced while the opening area of the flow passage connecting the P port to the B port and the opening area of the flow passage connecting the T port to the A port each gradually increase, all in correspondence to the level of the bucket dump pilot pressure. Namely, as the bucket dump pilot pressure reaches a high level, the spool moves so that pressure oil from the main pump 6 is delivered into the rod-side oil chamber 115*b* at the bucket cylinder 115 and that the bottom-side oil chamber 115*a* of the bucket cylinder 115 becomes connected to the hydraulic fluid tank 7. As a result, the cylinder rod at the bucket cylinder 115 retracts, thereby causing a downward swing of the bucket 112 (bucket 112 is set at a dumping position).

The flow control valve 43 is disposed on the parallel oil passage that connects, via the check valve, the main pump 6 and the P port of the arm control valve 41. Via the flow control valve 43, the flow rate of pressure oil flowing to the P port of the arm control valve 41 is controlled in correspondence to the pressure of the pilot pressure oil (electromagnetic proportional valve output pressure), which is supplied via the electromagnetic proportional valve 44. Namely, pressure oil flow rate is controlled so that the flow rate of pressure oil supplied to the P port of the arm control valve 41 is lowered by constricting the parallel oil passage as the pressure of the pilot pressure oil supplied to the flow control valve 43 increases and that pressure oil is supplied to the P port of the arm control valve 41 without restriction by opening up the parallel oil passage as the pressure of the pilot pressure oil becomes lower.

Figure 3:
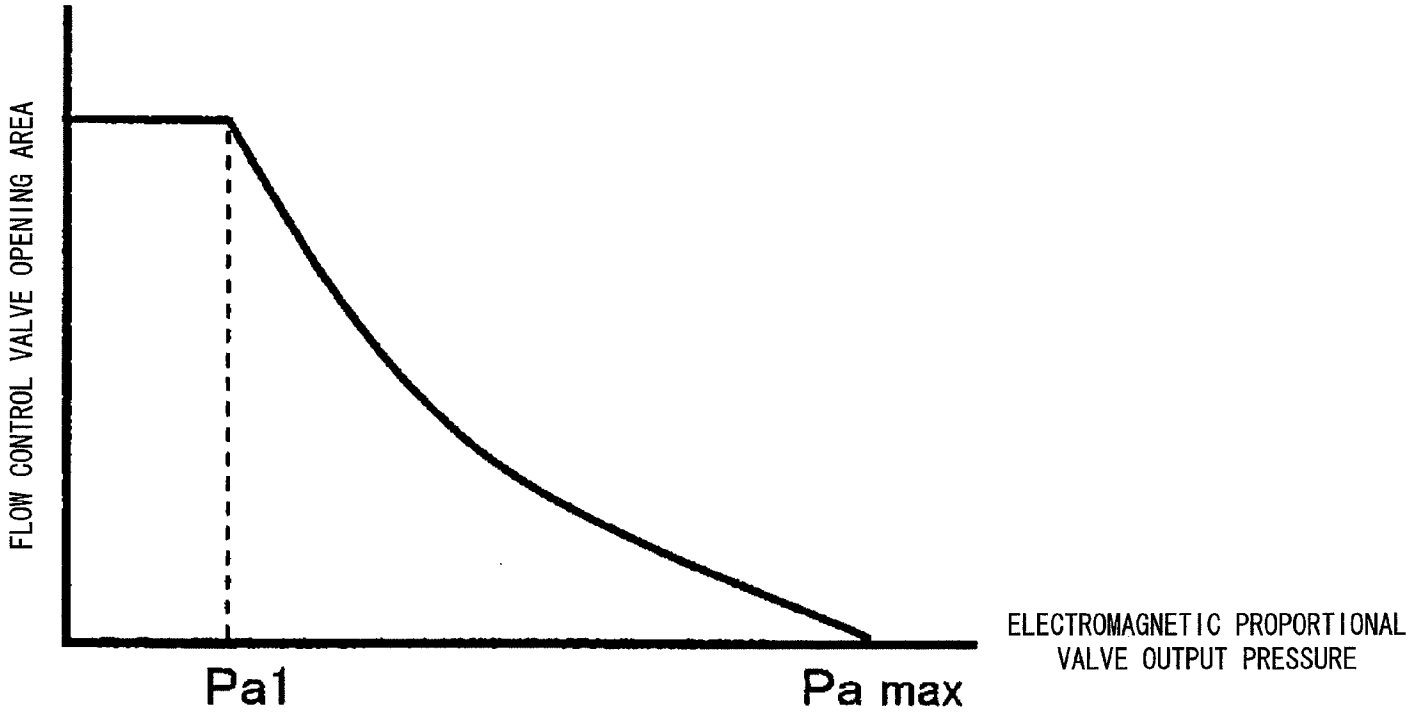
FIG. 3 is a diagram indicating the relationship between the electromagnetic proportional valve output pressure and the opening area of the flow passage at the flow control valve.

FIG. 3 is a diagram indicating the relationship between the electromagnetic proportional valve output pressure and the opening area of the flow passage at the flow control valve 43. As long as the electromagnetic proportional valve output pressure remains equal to or less than a pressure Pal, the maximum opening area is sustained for the flow passage at the flow control valve 43. However, once the electromagnetic proportional valve output pressure exceeds the predetermined pressure Pal, the opening area of the flow passage at the flow control valve 43 becomes gradually reduced as the electromagnetic proportional valve output pressure increases. Then, when the electromagnetic proportional valve output pressure reaches a predetermined level Pamax, the opening area of the flow passage at the flow control valve 43 becomes equal to 0 and thus, the parallel oil passage is cut off It is to be noted that the electromagnetic proportional valve output pressure is determined by a control signal (solenoid excitation output) provided to the electromagnetic proportional valve 44 by the controller 10.

Based upon the output from the controller 10, the electromagnetic proportional valve 44 controls the pressure of the pilot pressure oil supplied from the pilot pump 46 to the flow control valve 43, as will be described in detail later.

The controller 10 is a control device that controls the various units constituting the wheel loader 100 and also outputs the control signal to the electromagnetic proportional valve 44. The controller 10 is configured with an arithmetic processing device comprising a CPU, a ROM, a RAM, other peripheral circuits and the like. In addition to the various sensors 51 through 55 mentioned earlier, a torque converter input shaft rotation rate sensor 13 that detects a rotation rate Ni of the input shaft of a torque converter, a torque converter output shaft rotation rate sensor 14 that detects a rotation rate Nt of the output shaft of the torque converter, an arm angle sensor 56 that detects the angle of the arm 111 relative to the front body 110 and an angle adjustment switch 57, to be described in detail later, are connected to the controller 10. It is to be noted that the controller 10 calculates a torque converter speed ratio e=(Nt/Ni) representing the ratio of the torque converter input shaft rotation rate Ni and the torque converter output shaft rotation rate Nt respectively detected via the torque converter input shaft rotation rate sensor 13 and the torque converter output shaft rotation rate sensor 14.

The angle adjustment switch 57, operated by the operator to set a specific angle to be assumed by the arm 111 as a flow rate control start condition for starting flow rate control via the flow control valve 43, is installed within the operator's cab 121.

This hydraulic circuit assumes a structure, so called a parallel hydraulic circuit structure, with the arm control valve 41 and the bucket control valve 42 disposed in parallel relative to the flow of pressure oil from the main pump 6. The flow control valve 43 is disposed on the upstream side of the arm control valve 41 relative to the flow of pressure oil from the main pump 6. It is to be noted that the flow control valve 43 is disposed in parallel to the bucket control valve 42 and the bucket cylinder 115 relative to the flow of pressure oil from the main pump 6.

As long as the flow of pressure oil from the main pump 6 is not restricted via the flow control valve 43, the hydraulic circuit operates as a parallel hydraulic circuit allowing pressure oil to be supplied simultaneously to the arm cylinder 114 and the bucket cylinder 115. Thus, the arm 111 and the bucket 112 can be engaged in rotating operation at the same time at the wheel loader 100 equipped with this hydraulic circuit.

The wheel loader 100 in the embodiment may be engaged in combined operation, whereby after dirt in the bucket 112 is dumped, the bucket 112 is operated to resume an angular position parallel to the ground surface while lowering the arm 111. The arm 111 must swing upward and the bucket 112 must swing downward before the dirt in the bucket 112 can be dumped. Once the dirt has been dumped, the arm down pilot pressure is applied to the aim control valve 41, thereby connecting the P port and the B port and connecting the T port and the A port at the arm control valve 41, so as to swing the bucket 112 upward to allow it to resume the angular position parallel to the ground surface, i.e., the horizontal position, while lowering the arm 111. In addition, the bucket tilt pilot pressure is applied to the bucket control valve 42 to connect the P port to the A port and connect the T port to the B port.

However, the arm 111 is subjected to the downward force of gravity, resulting in a reduction in the pressure in the rod-side oil chamber 114*b* at the arm cylinder 114. Thus, in a parallel hydraulic circuit in the related art, which does not include the flow control valve 43, pressure oil from the main pump 6 would be supplied with priority to the rod-side oil chamber 114*b* at the arm cylinder 114, leading to a insufficiency of pressure oil delivered into the bottom-side oil chamber 115*a* at the bucket cylinder 115. Under such circumstances, the bucket 112 would not be able to swing upward with ease. In other words, the arm 111 would be pulled completely downward before the bucket 112 was able to resume the horizontal attitude.

In addition, the work vehicle may be engaged in combined operation whereby a load such as dirt is scooped up by tilting the bucket 112 while the arm 111 is raised. In such a situation, the pressure in the bottom chamber 114*a* at the arm cylinder 114 and the pressure in the bottom chamber 115*a* at the bucket cylinder 115 will rise, causing pressure oil to flow both to the arm cylinder 114 and the bucket cylinder 115 from the main pump 6 and thus giving rise to a problem in that the load cannot be hauled of a significant distance due to an insufficient increase in the rotating speed of the bucket 112.

The hydraulic circuit achieved in the embodiment prevents an occurrence of the problematic situation described above by restricting the flow of pressure oil to the arm control valve 41 from the main pump 6 via the flow control valve 43 and thus supplying pressure oil to the bucket control valve 42 with priority when the work vehicle is engaged in combined operation during which the arm 111 and the bucket 112 are caused to swing simultaneously. The following is a detailed description of pressure oil flow rate control achieved via the flow control valve 43.

At the hydraulic circuit achieved in the embodiment, a decision as to whether the wheel loader 100 is engaged in a digging operation or a non-digging operation is made based upon a predetermined condition and if the wheel loader 100 is determined to be engaged in a non-digging operation, the flow of pressure oil from the main pump 6 to the arm control valve 41 is restricted via the flow control valve 43, upon determining, based upon another condition, that a combined operation, whereby the arm 111 and the bucket 112, for instance, are both operating simultaneously, is in progress.

The controller 10 may determine that the wheel loader 100 is currently engaged in a digging operation (the wheel loader 100 is in a digging state) if the following conditions are all satisfied and determine that the wheel loader is in a non-digging state if any of the following conditions is not satisfied.

(1) The outlet pressure at the main pump 6, detected via the pressure sensor 55, exceeds a predetermined level. Namely, the load on the main pump 6 is high.

(2) The angle of the arm 111, detected by the arm angle sensor 56, is equal to or less than a predetermined angle. Namely, the position currently assumed by the arm 111 is low.

(3) The torque converter speed ratio e, calculated based upon the torque converter input shaft rotation rate Ni and the torque converter output shaft rotation rate Nt, respectively detected via the torque converter input shaft rotation rate sensor 13 and the torque converter output shaft rotation rate sensor 14, is equal to or less than a predetermined value. Namely, while the wheel loader 100 is traveling at low speed, the rotation rate at the engine 1 is high and thus the traveling load is significant.

(A) When the wheel loader 100 is determined to be engaged in a digging operation Upon determining that the wheel loader 100 is engaged in a digging operation, the controller 10 demagnetizes the solenoid at the electromagnetic proportional valve 44. As a result, the electromagnetic proportional valve output pressure at the electromagnetic proportional valve 44 is lowered to 0, allowing the opening area of the flow passage at the flow control valve 43 to be maximized. As a result, the arm cylinder 114 is driven in response to an operation of the corresponding operation lever (not shown) during the digging operation without the flow rate of pressure oil flowing to the P port of the arm control valve 41 being restricted via the flow control valve 43.

(B) When the wheel loader 100 is determined to be in a non-digging state

Upon determining that the wheel loader 100 is currently in a non-digging state, the controller 10 decides, based upon the various pilot pressures detected via the respective pilot pressure sensors 51 through 54, that a combined operation is underway if the pressure detected via the arm up pilot pressure sensor 51 or the aim down pilot pressure sensor 52 is equal to or higher than a predetermined level and the pressure detected via the bucket tilt pilot pressure sensor 53 or the bucket dump pilot pressure sensor 54 is equal to or higher than a predetermined level. Depending upon whether or not a combined operation is underway, the controller 10 controls the flow control valve 43 (i.e., the electromagnetic proportional valve output pressure at the electromagnetic proportional valve 44) as described below.

(B-1) After determining that a combined operation is not underway

Upon determining that a combined operation is not currently underway based upon the various pilot pressures, the controller 10 demagnetizes the solenoid at the electromagnetic proportional valve 44. As a result, the electromagnetic proportional valve output pressure at the electromagnetic proportional valve 44 is lowered to 0, allowing the opening area of the flow passage at the flow control valve 43 to be maximized. As a result, the arm cylinder 114 is driven in response to an operation of the corresponding operation lever (not shown) as long as no combined operation is in progress without the flow rate of pressure oil flowing to the P port of the aim control valve 41 being restricted via the flow control valve 43.

(B-2) After determining that a combined operation is underway

Upon determining, based upon the various pilot pressures, that a combined operation is underway, the controller 10 controls the flow control valve 43 so as to lower the flow rate of pressure oil flowing to the P port of the arm control valve 41 with increase in the extent to which the operation lever (not shown), via which the bucket 112 is operated, is operated. Namely, the controller 10 controls the electromagnetic proportional output pressure at the electromagnetic proportional valve 44 by controlling the output signal provided to the electromagnetic proportional valve 44 so that the degree of priority with which the bucket 112 is driven over the arm 111 increases as the extent to which the operation lever (not shown) for the bucket 112 is operated increases.

Figure 4:
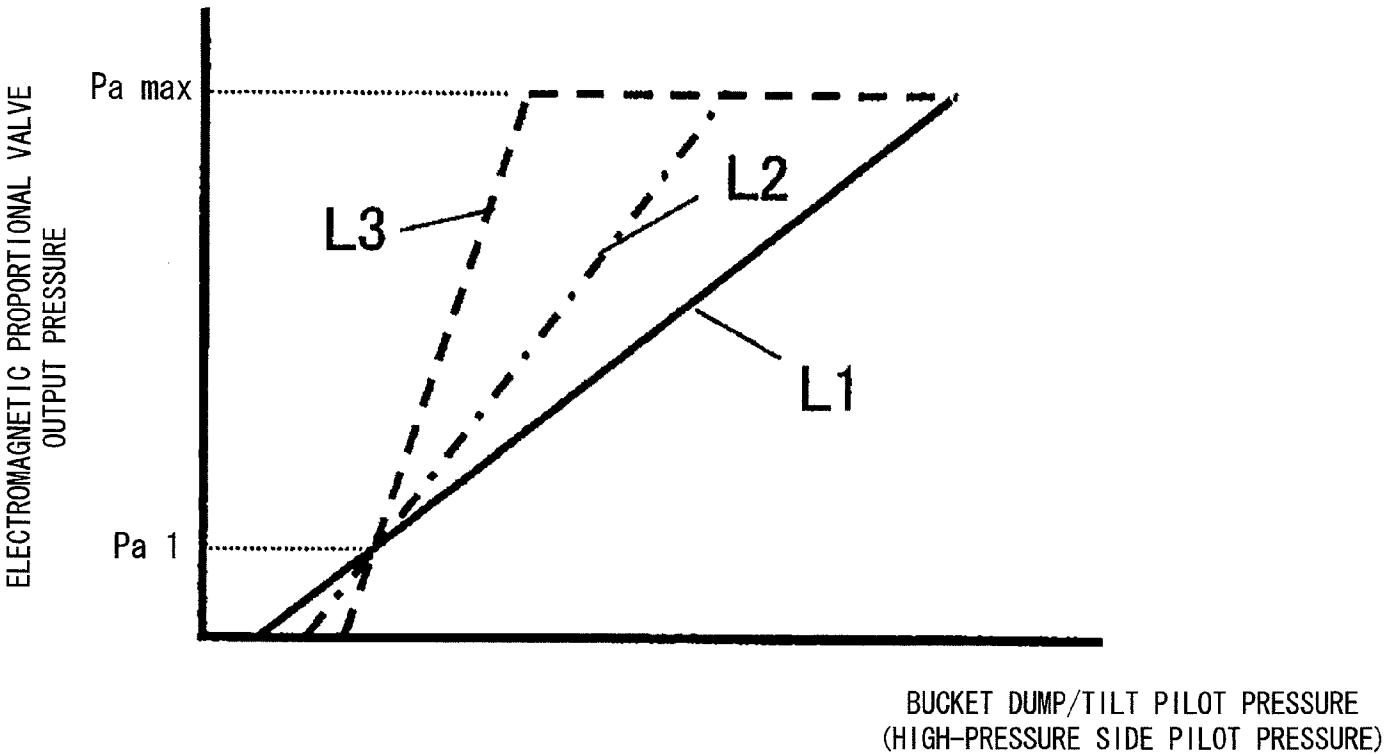
FIG. 4 is a diagram indicating varying relationships between the pilot pressure at the bucket control valve and the electromagnetic proportional valve output pressure at the electromagnetic proportional valve.

FIG. 4 presents a diagram indicating varying relationships between the pilot pressure (the bucket tilt pilot pressure and the bucket dump pilot pressure) applied to the bucket control valve 42 and the electromagnetic proportional valve output pressure at the electromagnetic proportional valve 44. The controller 10 controls the output signal provided to the electromagnetic proportional valve 44 so that the electromagnetic proportional valve output pressure at the electromagnetic proportional valve 44 achieves one of the corresponding relationships L1 to L3 in FIG. 4 in correspondence to the high-pressure side pilot pressure, i.e., the higher of either the pilot pressure detected by the bucket tilt pilot pressure sensor 53 or the pilot pressure detected by the bucket dump pilot pressure sensor 54. These corresponding relationships L1 through L3 are determined in advance based upon the relationship between the extent of displacement of the spool at the bucket control valve 42 and the opening area of the flow passage at the bucket control valve 42, as will be explained later.

Figure 5:
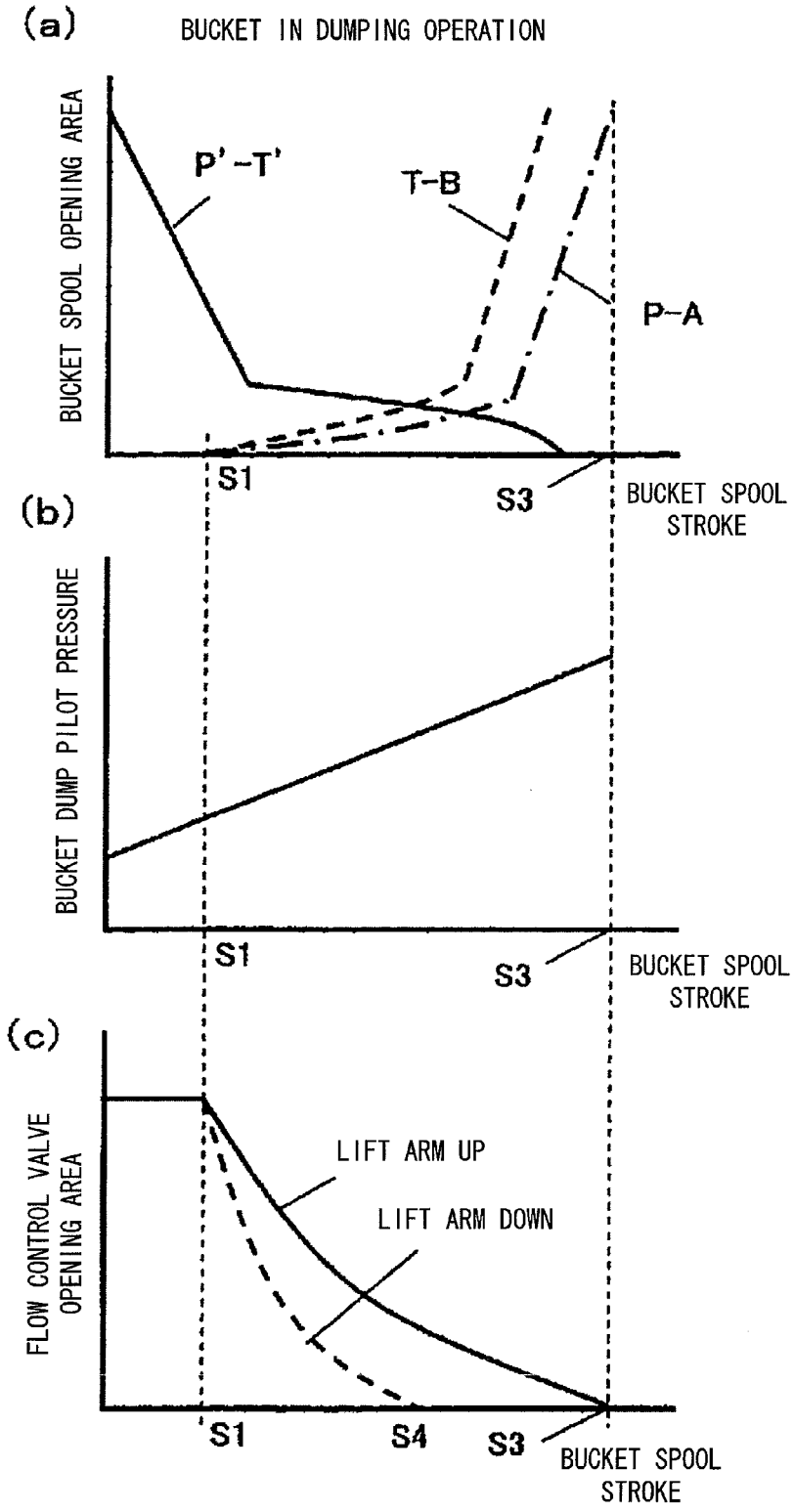
FIGS. 5(*a*) through 5(*f*) are diagrams indicating the relationships of the opening area of the flow passage at the bucket control valve, the high-pressure side pilot pressure and the opening area of the flow passage at the flow control valve to the bucket spool stroke.
Figure 5:
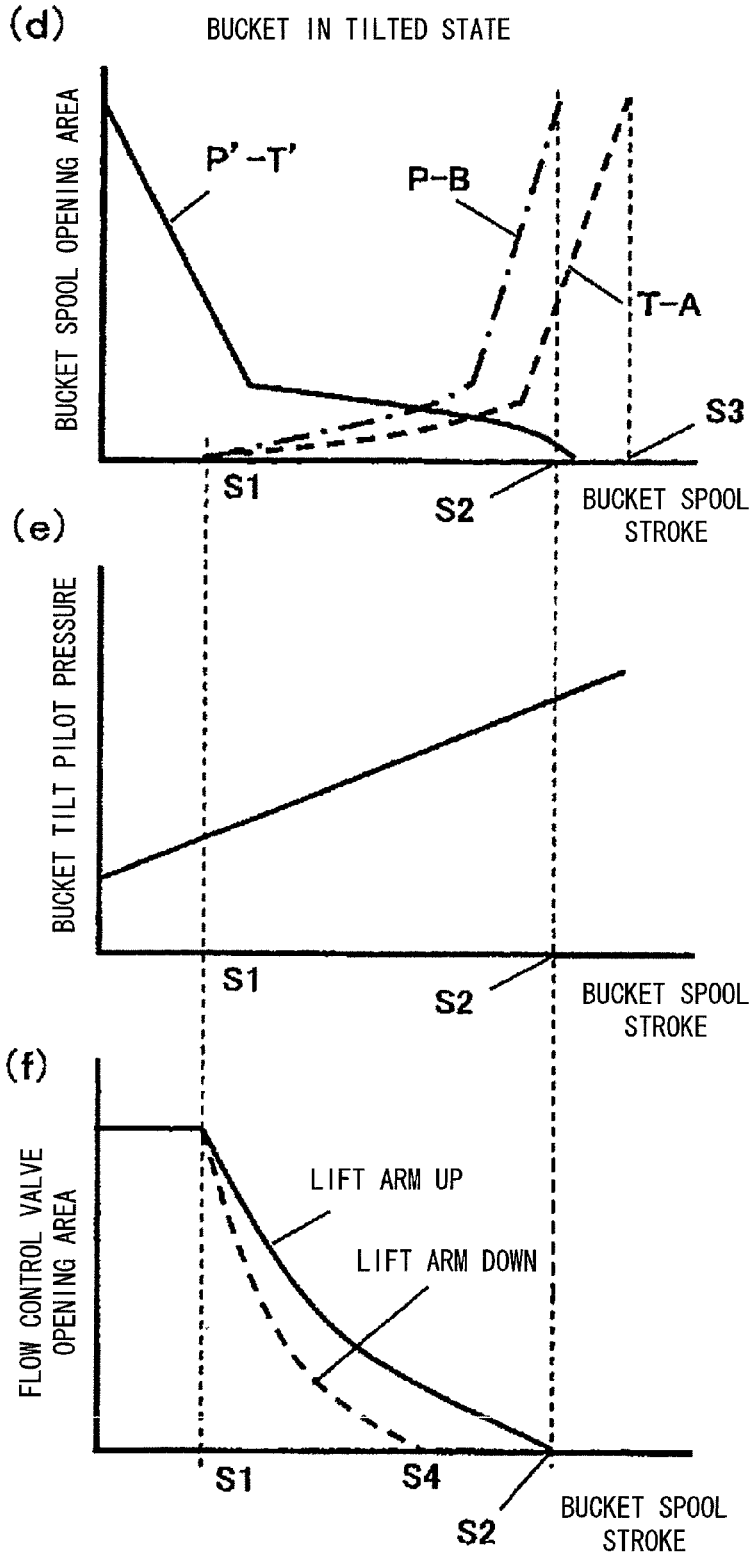

FIG. 5(*a*) indicates the relationship between the bucket spool stroke and the opening area of the flow passage at the bucket control valve 42 observed when the bucket 112 is swung downward (when the bucket is engaged in a dumping operation). FIG. 5(*b*) indicates the relationship between the bucket spool stroke and the high-pressure side pilot pressure (the bucket dump pilot pressure) observed when the bucket is engaged in a dumping operation. FIG. 5(*c*) indicates the relationship between the bucket spool stroke and the opening area of the flow passage at the flow control valve 43 observed when the bucket is engaged in a dumping operation. FIG. 5(*d*) indicates the relationship between the bucket spool stroke and the opening area of the flow passage at the bucket control valve 42 observed when the bucket 112 is swung upward (when the bucket is tilted). FIG. 5(*e*) indicates the relationship between the bucket spool stroke and the high-pressure side pilot pressure (the bucket tilt pilot pressure) observed when the bucket is tilted. FIG. 5(*f*) indicates the relationship between the bucket spool stroke and the opening area of the flow passage at the flow control valve 43 observed when the bucket is tilted.

(B-2-1) When the bucket is engaged in dumping operation

When the bucket is engaged in a dumping operation, the opening area of the flow passage connecting the P' port to the T' port becomes smaller, as indicated by the line P'-T' in FIG. 5(*a*), as the bucket spool stroke lengthens. In addition, while there is no opening in the flow passage connecting the P port to the A port until the bucket spool stroke position reaches the point S1, the opening area starts to increase once the bucket spool stroke position passes the point S1 and the maximum opening area is achieved at the point S3, as indicated by the line P-A in FIG. 5(*a*). While there is no opening in the flow passage connecting the T port to the B port until the bucket spool stroke position reaches the point S1, the opening area starts to increase once the bucket spool stroke position passes the point S1 and the maximum opening area is achieved at a stroke shorter than the point S3, as indicated by the line T-B in FIG. 5(*a*). It is to be noted that the bucket spool stroke is substantially in proportion to the bucket dump pilot pressure, as indicated in FIG. 5(*b*).

The controller 10 controls the output signal provided to the electromagnetic proportional valve 44 so as to sustain the maximum opening area in the flow passage at the flow control valve 43 until the bucket spool stroke position reaches point S1, as indicated in FIG. 5(*c*). In other words, the controller 10 controls the output signal for the electromagnetic proportional valve 44 so as not to restrict the flow rate of pressure oil flowing to the P port of the arm control valve 41 until the flow passage connecting the P port to the A port and the flow passage connecting the T port to the B port start to open. By ensuring that the flow of pressure oil provided to the arm cylinder 114 is not restricted via the flow control valve 43 while the bucket cylinder 115 is not driven as described above, any unnecessary restriction on the drive of the arm cylinder 114 is prevented.

The controller 10 controls the output signal provided to the electromagnetic proportional valve 44 so that once the bucket spool stroke position moves beyond S1, the opening area of the flow passage at the flow control valve 43 becomes gradually smaller as the bucket spool stroke lengthens. It is to be noted that the controller 10 executes control so that the bucket spool stroke and the opening area of the flow passage at the flow control valve 43 assume different relationships to each other when the arm 111 is swung upward (when the lift arm is raised) and when the arm 111 is swung downward (when the lift arm is lowered), as detailed below.

Namely, when the lift arm is lowered, the controller 10 ensures that the opening area of the flow passage at the flow control valve 43 decreases by a greater extent relative to the extent of bucket spool stroke increase, compared to the extent to which the opening area decreases when the lift arm is raised. In more specific terms, the controller 10 controls the output signal provided to the electromagnetic proportional valve 44 so that the bucket dump pilot pressure and the electromagnetic proportional valve output pressure at the electromagnetic proportional valve 44 achieve the corresponding relationship represented by L3 in FIG. 4 when the lift arm is lowered and that the bucket dump pilot pressure and the electromagnetic proportional valve output pressure at the electromagnetic proportional valve 44 achieve the corresponding relationship represented by L1 in FIG. 4 when the lift arm is raised. As a result, even at a shorter bucket spool stroke, a greater restriction is imposed on the opening area of the flow passage at the flow control valve 43 when the lift arm is lowered, compared to the level of restriction imposed on the opening area of the flow passage when the lift arm is raised. For instance, when the lift arm is lowered, the controller 10 executes control so that the flow of pressure oil to the P port at the arm control valve 41 is cut off via the flow control valve 43 at, for instance, a bucket spool stroke point S4 in FIG. 5(*c*).

It is to be noted that when the lift arm is raised, the flow of pressure oil to the P port of the arm control valve 41 is cut off via the flow control valve 43 as the bucket spool stroke position reaches the point S3, at which the maximum opening area is achieved for the flow passage connecting the P port to the A port. In other words, the corresponding relationship represented by L1 in FIG. 4 is determined in advance so as to ensure that when the lift arm is raised, the flow of pressure oil to the P port of the arm control valve 41 is cut off via the flow control valve 43 as the bucket spool stroke position reaches S3.

Control is executed to achieve different relationships between the bucket spool stroke and the opening area of the flow passage at the flow control valve 43 when the lift arm is raised and when the lift arm is lowered as described above for the following reasons. When the lift arm is lowered, it is necessary to more aggressively restrict the flow of pressure oil toward the arm cylinder 114 via the flow control valve 43, in order to prevent the occurrence of the problematic condition under which pressure oil cannot be delivered readily to the bucket cylinder 114 and thus the bucket 112 cannot rotate smoothly due to the arm 111 being pulled down by its own weight. In contrast, when the lift arm is raised, delivery of pressure oil to the bucket cylinder 115 is not hindered by the weight of the arm 111, but it is still necessary to restrict the flow of pressure oil to the arm cylinder 114 with the flow control valve 43 so as to allow the bucket 112 to rotate with priority as in a tandem hydraulic circuit. For this reason, the electromagnetic proportional valve output pressure is made to change more sharply relative to the high-pressure side pilot pressure in the relationship represented by L3 compared to the change in the electromagnetic proportional valve output pressure in the relationship represented by L1, as indicated in FIG. 4.

It is to be noted that the control system is configured so that when the lift arm is up, the flow rate control is executed as described above via the flow control valve 43 only if the arm 111 assumes a position higher than the angular position set by the operator, by operating the angle adjustment switch 57.

(B-2-2) When the bucket is tilted

When the bucket is tilted, the opening area of the flow passage connecting the P' port to the T' port becomes smaller, as indicated by the line P'-T' in FIG. 5(*d*), as the bucket spool stroke lengthens. In addition, while there is no opening in the flow passage connecting the P port to the B port until the bucket spool stroke position reaches the point S1, the opening area starts to increase once the bucket spool stroke position passes the point S1 and the maximum opening area is achieved at the point S2, shorter than S3, as indicated by the line P-B in FIG. 5(*d*). In addition, while there is no opening in the flow passage connecting the T port to the A port until the bucket spool stroke position reaches the point S1, the opening area starts to increase once the bucket spool stroke position passes the point S1 and the maximum opening area is achieved at the point S3, as indicated by the line T-A in FIG. 5(*d*). It is to be noted that the bucket spool stroke is substantially in proportion to the bucket tilt pilot pressure, i.e., the pilot pressure applied to tilt the bucket, as indicated in FIG. 5(*e*).

The controller 10 controls the output signal provided to the electromagnetic proportional valve 44 so as to sustain the maximum opening area in the flow passage at the flow control valve 43 until the bucket spool stroke position reaches point S1, as indicated in FIG. 5(*f*). In other words, the controller 10 controls the output signal for the electromagnetic proportional valve 44 so as not to restrict the flow rate of pressure oil flowing to the P port of the arm control valve 41 until the flow passage connecting the P port to the B port and the flow passage connecting the T port to the A port start to open. By ensuring that the flow of pressure oil provided to the arm cylinder 114 is not restricted via the flow control valve 43 while the bucket cylinder 115 is not driven as described above, as when the bucket is engaged in a dumping operation, any unnecessary restriction on the drive of the arm cylinder 114 is prevented.

The controller 10 controls the output signal provided to the electromagnetic proportional valve 44 so that once the bucket spool stroke position moves beyond S1, the opening area of the flow passage at the flow control valve 43 becomes gradually smaller as the bucket spool stroke lengthens. It is to be noted that the controller 10 executes control so that the bucket spool stroke and the opening area of the flow passage at the flow control valve 43 assume different relationships to each other when the lift arm is raised and when the lift aim is lowered, as detailed below.

Namely, when the lift arm is lowered, the controller 10 ensures that the opening area of the flow passage at the flow control valve 43 decreases by a greater extent relative to the extent of bucket spool stroke increase, compared to the extent to which the opening area decreases when the lift arm is raised. In more specific terms, the controller 10 controls the output signal provided to the electromagnetic proportional valve 44 so that the bucket tilt pilot pressure and the electromagnetic proportional valve output pressure at the electromagnetic proportional valve 44 achieve the corresponding relationship represented by L3 in FIG. 4 when the lift arm is lowered and that the bucket tilt pilot pressure and the electromagnetic proportional valve output pressure at the electromagnetic proportional valve 44 achieve the corresponding relationship represented by L2 in FIG. 4 when the lift arm is raised. As a result, even at a shorter bucket spool stroke, a greater restriction is imposed on the opening area of the flow passage at the flow control valve 43 when the lift arm is lowered, compared to the level of restriction imposed on the opening area of the flow passage when the lift arm is raised. For instance, when the lift arm is lowered, the controller 10 executes control so that the flow of pressure oil to the P port at the arm control valve 41 is cut off via the flow control valve 43 at, for instance, the bucket spool stroke point S4 in FIG. 5(*f*).

It is to be noted that when the lift arm is raised, the flow of pressure oil to the P port of the arm control valve 41 is cut off via the flow control valve 43 as the bucket spool stroke position reaches the stroke point S2, at which the maximum opening area is achieved for the flow passage connecting the P port to the B port. In other words, the corresponding relationship represented by L2 in FIG. 4 is determined in advance so as to ensure that when the lift arm is raised, the flow of pressure oil to the P port of the arm control valve 41 is cut off via the flow control valve 43 as the bucket spool stroke position reaches S2.

Based upon the rationale described in reference to the bucket dumping operation, it is ensured that different relationships are also achieved by the bucket spool stroke and the opening area of the flow passage at the flow control valve 43 in the lift arm up state and in the lift arm down state when the bucket is tilted. It is to be noted that the control system is configured so that the flow rate control is executed as described above via the flow control valve 43 only if the arm 111 assumes a position higher than the angular position set by the operator, by operating the angle adjustment switch 57 when the bucket is tilted, as when the bucket is engaged in a dumping operation.

—Flowchart—

Figure 6:
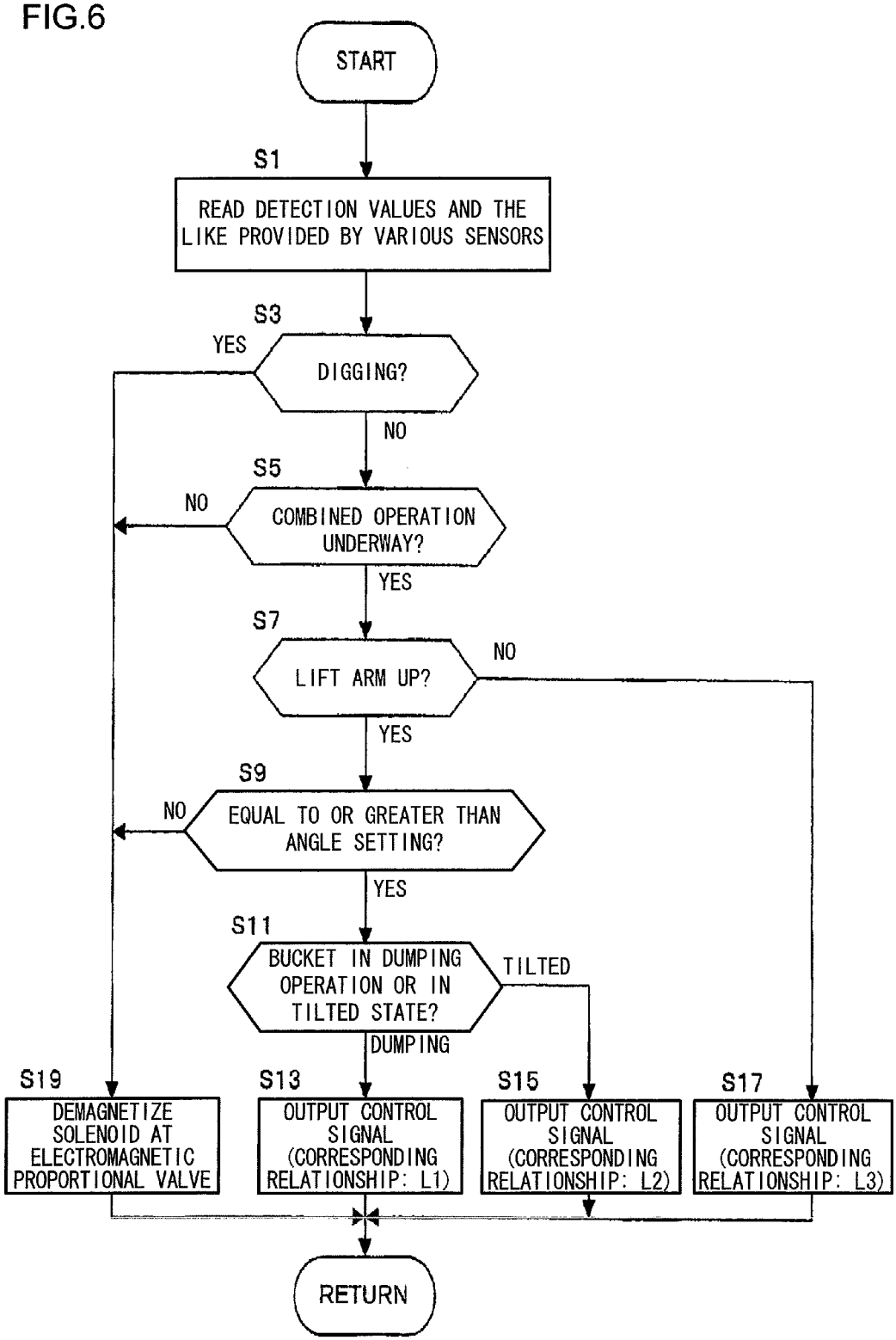
FIG. 6 presents a flowchart of the output processing operation through which a control signal is output to the electromagnetic proportional valve.

FIG. 6 presents a flowchart of the output processing operation executed in the embodiment with regard to the control signal output to the electromagnetic proportional valve 44. A program enabling the processing shown in FIG. 6 is started up as an ignition switch (not shown) at the wheel loader 100 is turned on, and the processing is subsequently executed repeatedly by the controller 10. In step S1, the controller 10 reads the detection values provided via the individual sensors and the angle setting at the angle adjustment switch 57, before the operation proceeds to step S3. In step S3, a decision is made based upon the detection values and the like having been read in step S1 as to whether or not the work vehicle is currently in a digging state, as has been explained earlier.

If a negative decision is made in step S3, i.e., if the work vehicle is determined to be in a non-digging state, the operation proceeds to step S5 to make a decision based upon the detection values provided via the sensors 51 through 54, having been read in step S1, as to whether or not a combined operation is currently underway. If an affirmative decision is made in step S5, the operation proceeds to step S7, in which the controller 10 makes a decision based upon the detection values provided via the sensors 51 and 52, having been read in step S1, as to whether or not the lift arm is in an up state. If an affirmative decision is made in step S7, the operation proceeds to step S9, in which the controller makes a decision based upon the angle setting at the angle adjustment switch 57 and the angle detected by the arm angle sensor 56, having been read in step S1, as to whether or not the angle of the arm 111 is equal to or greater than the angle setting. If an affirmative decision is made in step S9, the operation proceeds to step S11, in which the controller makes a decision based upon the detection values provided by the sensors 53 and 54, having been read in step S1, as to whether the bucket 112 is engaged in a dumping operation or the bucket 112 is tilted.

If it is decided in step S11 that the bucket 112 is engaged in a dumping operation, the operation proceeds to step S13 to output a control signal for the electromagnetic proportional valve 44 so as to achieve the corresponding relationship represented by L1 in FIG. 4 for the high-pressure side pilot pressure and the electromagnetic proportional valve output pressure at the electromagnetic proportional valve 44, before proceeding to the return.

If it is decided in step S11 that the bucket 112 is engaged in tilted, the operation proceeds to step S15 to output a control signal for the electromagnetic proportional valve 44 so as to achieve the corresponding relationship represented by L2 in FIG. 4 for the high-pressure side pilot pressure and the electromagnetic proportional valve output pressure at the electromagnetic proportional valve 44, before proceeding to the return.

If a negative decision is made in step S7, the operation proceeds to step S17 to output a control signal for the electromagnetic proportional valve 44 so as to achieve the corresponding relationship represented by L3 in FIG. 4 for the high-pressure side pilot pressure and the electromagnetic proportional valve output pressure at the electromagnetic proportional valve 44, before proceeding to the return.

If an affirmative decision is made in step S3, if a negative decision is made in step S5 or if a negative decision is made in step S9, the operation proceeds to step S19 to output a control signal so as to demagnetize the solenoid at the electromagnetic proportional valve 44 before proceeding to the return.

The following advantages are achieved in a work vehicle equipped with the hydraulic control device described above.

(1) The arm control valve 41 and the bucket control valve 42 are disposed in parallel to the flow of pressure oil from the main pump 6, with the flow control valve 43 disposed upstream relative to the arm control valve 41. Once it is decided that a combined operation for driving the arm cylinder 114 and the bucket cylinder 115 simultaneously has been performed, the flow of pressure oil from the main pump 6 toward the arm control valve 41 is restricted via the flow control valve 43. This structure, adopted in a parallel hydraulic circuit enabling combined operations, makes it possible to effectively prevent the occurrence of any undesirable condition attributable to a decrease in the rotating speed of the bucket 112 that would otherwise manifest while a combined operation is underway. As a result, a hydraulic control device and a work vehicle achieving a high level of work efficiency, which assure both improved operability during combined operations through the parallel hydraulic circuit system and effective prevention of any undesirable conditions that tend to occur in parallel hydraulic circuit configurations, can be provided.

(2) The flow of pressure oil from the main pump 6 toward the arm control valve 41 is restricted via the flow control valve 43 in correspondence to the relationship between the bucket spool stroke and the opening area of the flow passage at the bucket control valve 42, i.e., in correspondence to the flow rate control characteristics of the bucket control valve 42, as indicated in FIGS. 5(*a*) through 5(*f*). These measures assure smooth movement of the arm cylinder, the supply of pressure oil to which is restricted, and ultimately smoother movement of the arm 111. As a result, the operability of the arm 111 will remain intact.

(3) The restriction on the flow rate of pressure oil flowing to the P port of the arm control valve 41 gradually comes into effect only after the bucket spool stroke position moves beyond S1. This means that the flow of pressure oil provided to the arm cylinder 114 is not restricted via the flow control valve 43 unless the bucket cylinder 115 is being driven, and ultimately that since the outlet pressure at the main pump 6 never rises to a high level unexpectedly, relief via the main relief valve 45 is not required.

(4) The flow of pressure oil toward the P port of the arm control valve 41 is cut off via the flow control valve 43 as the maximum opening area is achieved for the flow passage connecting the P port to the A port when the bucket is engaged in a dumping operation and as the maximum opening area is achieved for the flow passage connecting the P port to the B port when the bucket is tilted. As a result, the speed with which the bucket 112 opens can be increased with a high level of reliability, thereby making it possible to prevent any problematic conditions that may occur due to decrease in the rotating speed of the bucket 112.

(5) The flow of pressure oil from the main pump 6 toward the arm control valve 41 is restricted via the flow control valve 43 both when the lift arm is raised and when the lift arm is lowered. Thus, it is ensured that the load can be hauled over a sufficient distance when the lift arm is raised and that the bucket 112 is allowed to promptly resume the initial position when the lift arm is lowered.

(6) Different relationships are achieved for the bucket spool stroke and the opening area of the flow passage at the flow control valve 43 when the lift arm is raised and when the lift arm is lowered. Through these measures, it is ensured that the arm cylinder 114 is driven under optimal control in correspondence to the current work conditions and ultimately that the operator is able to work without uncomfortable sensations.

(7) When the lift arm is raised, the flow rate control via the flow control valve 43 is executed as described above only if the arm 111 assumes a position higher than the angular position having been set by the operator by operating the angle adjustment switch 57. Thus, the operator is able to select the optimal timing with which the flow rate control via the flow control valve 43 comes into effect and maximum convenience is assured in a variety of work sites with varying heights to which dirt or the like to be excavated is piled and varying heights to which the dirt having been excavated is to be dumped.

—Variations—

(1) While the flow of pressure oil from the main pump 6 toward the arm control valve 41 is restricted as necessary via the flow control valve 43 in correspondence to the flow rate control characteristics of the bucket control valve 42 in the description provided above, the present invention is not limited to this example. For instance, regardless of the flow rate control characteristics of the bucket control valve 42, pressure oil may be allowed to flow to the P port of the arm control valve 41 without any restriction whatsoever until the bucket spool stroke position reaches a predetermined stroke point and then the flow of pressure oil toward the P port of the arm control valve 41 may be cut off as the bucket spool stroke position reaches the predetermined stroke point. In such a case, an abrupt stop to the rotation of the arm 111 can be prevented by ensuring that a predetermined length of time (e.g., several seconds) elapses between the time point at which the flow cutoff starts and the time point at which the flow cutoff is complete.

(2) In the embodiment described above, the flow of pressure oil from the main pump 6 toward the arm control valve 41 is cut off via the flow control valve 43 once the bucket spool stroke position reaches a predetermined stroke point (S2 or S3). However, the present invention is not limited to this example. For instance, even when the bucket spool stroke position reaches the predetermined stroke point (S2 or S3), pressure oil may be allowed to flow in a small quantity to the arm control valve 41 instead of completely cutting off the flow of pressure oil to the arm control valve 41 from the main pump 6 via the flow control valve 43.

(3) While different relationships are assumed for the bucket spool stroke and the opening area of the flow passage at the flow control valve 43 when the lift arm is raised and when the lift arm is lowered in the description provided above, it is not absolutely essential that the relationship between the bucket spool stroke and the opening area of the flow passage at the flow control valve 43 be different for the lift arm up state and for the lift arm down state.

(4) While the flow of pressure oil from the main pump 6 toward the arm control valve 41 is restricted via the flow control valve 43 both when the lift arm is raised and when the lift arm is lowered in the description of the embodiment provided above, the present invention is not limited to this example. For instance, the flow of pressure oil from the main pump 6 toward the arm control valve 41 may be restricted via the flow control valve 43 only either when the lift arm is raised or when the lift arm is lowered, so as to achieve advantages similar to those described above only in the lift arm up state or in the lift arm down state.

(5) The decision-making criteria used when making a decision as to whether or not the wheel loader 100 is currently engaged in a digging operation in the embodiment described earlier simply represent an example and the decision may be made based upon criteria other than those described above. For instance, the wheel loader 100 may be determined to be engaged in a digging operation if at least one of the conditions listed earlier is satisfied or a decision as to whether or not the wheel loader 100 is engaged in a digging operation may be made based upon different criteria.

(6) The embodiment and the variations thereof described above may be adopted in any combination.

It is to be noted that the present invention is not limited in any way whatsoever to the particulars of the embodiments described above and that any hydraulic control device for a work vehicle adopting any of various structures should be considered within the scope of the present invention, as long as it comprises a hydraulic pump that supplies pressure oil, an arm drive actuator that drives, with pressure oil supplied from the hydraulic pump, an arm attached to the work vehicle so as to swing the arm, a bucket drive actuator that drives, with pressure oil supplied from the hydraulic pump, a bucket attached to the front end of the arm, so as to swing the bucket, an arm drive pressure oil control valve that controls drive of the arm drive actuator by controlling pressure oil supplied from the hydraulic pump to the arm drive actuator, a bucket drive pressure oil control valve that controls drive of the bucket drive actuator by controlling pressure oil supplied from the hydraulic pump to the bucket drive actuator, an arm operating means for controlling the arm drive pressure oil control valve, a bucket operating means for controlling the bucket drive pressure oil control valve, operating state detection means for detecting operating states of the arm drive actuator and the bucket drive actuator and a flow control valve that restricts pressure oil to be supplied to the arm drive actuator as a combined operation of the arm drive actuator and the bucket drive actuator is detected via the operating state detection means.

The embodiment described above and variations thereof are simply provided as examples and components other than those in the embodiment may be used as long as the features characterizing the present invention are not compromised.

The disclosure of the following priority application is herein incorporated by reference:

Japanese Patent Application No. 2010-107255 filed May 7, 2010

The invention claimed is:

1. A hydraulic control device for a work vehicle, comprising:

a hydraulic pump that supplies pressurized oil;

an arm drive actuator that drives, with the pressurized oil supplied from the hydraulic pump, an arm attached to the work vehicle so as to swing the arm;

a bucket drive actuator that drives, with the pressurized oil supplied from the hydraulic pump, a bucket attached to a front end of the arm, so as to swing the bucket;

an arm drive pressurized oil control valve that controls drive of the arm drive actuator by controlling the pressurized oil supplied from the hydraulic pump to the arm drive actuator;

a bucket drive pressurized oil control valve that controls drive of the bucket drive actuator by controlling the pressurized oil supplied from the hydraulic pump to the bucket drive actuator;

an arm operation unit that controls the arm drive pressurized oil control valve;

a bucket operation unit that controls the bucket drive pressurized oil control valve;

an operating state detection unit that detects operating states of the arm drive actuator and the bucket drive actuator;

a flow control valve that restricts pressurized oil to be supplied to the arm drive actuator as combined operation of the arm drive actuator and the bucket drive actuator is detected via the operating state detection unit;

an angle detection unit that detects an angle of the arm;

an angle setting unit that sets a specific angle for the arm; and a control device configured to control the flow control valve to start restricting a quantity of pressurized oil supplied from the hydraulic pump and flowing into the arm drive actuator upon detecting via the angle detection unit that the angle of the arm reaches the angle set at the angle setting unit when the operating state detection unit concurrently detects an operation of the bucket drive actuator combined with an operation of the arm drive actuator along an arm raising direction.

2. A hydraulic control device for a work vehicle according to claim 1, wherein:

the flow control valve controls pressurized oil to be supplied to the arm drive actuator in correspondence to pressurized oil control characteristics of the bucket drive pressurized oil control valve.

3. A hydraulic control device for a work vehicle according to claim 1, further comprising:

a main relief valve that defines a maximum pressure for the pressurized oil supplied from the hydraulic pump, wherein:

the flow control valve controls pressurized oil to be supplied to the arm drive actuator so as to ensure that no pressurized oil is guided toward a tank from the main relief valve while a flow of pressurized oil toward the bucket drive actuator is cut off via the bucket drive pressurized oil control valve.

4. A hydraulic control device for a work vehicle according to claim 1, wherein:

the flow control valve cuts off a flow of pressurized oil toward the arm drive actuator while the bucket drive pressurized oil control valve is controlled so that the pressurized oil is supplied to the bucket drive actuator at a maximum flow rate.

5. A hydraulic control device for a work vehicle according to claim 1, wherein:

the flow control valve restricts a quantity of pressurized oil output from the hydraulic pump and flowing into the arm drive actuator both when an operation of the bucket drive actuator combined with an operation of the arm drive actuator along an arm lowering direction is detected via the operating state detection unit and when an operation of the bucket drive actuator combined with an operation of the arm drive actuator along an arm raising direction is detected via the operating state detection unit.

6. A hydraulic control device for a work vehicle according to claim 5, wherein:

the flow control valve assures different flow rate characteristics with regard to the pressurized oil output from the hydraulic pump and flowing into the arm drive actuator when the arm drive actuator is operated along the lowering direction and when the arm drive actuator is opened along the raising direction.

7. A hydraulic control device for a work vehicle according to claim 1, wherein:

the flow control valve restricts a quantity of the pressurized oil supplied from the hydraulic pump and flowing into the arm drive actuator only when the operating state detection unit detects an operation of the bucket drive actuator combined with an operation of the arm drive actuator along an arm lowering direction.

* * * * *